United States Patent [19]

Bishai

[11] Patent Number: 5,009,212

[45] Date of Patent: Apr. 23, 1991

[54] PORT FUEL INJECTION AND INDUCTION SYSTEM FOR INTERNAL COMBUSTION ENGINE

[75] Inventor: Macram N. Bishai, Windham, N.H.

[73] Assignee: McCord Winn Textron Inc., Winchester, Mass.

[21] Appl. No.: 466,587

[22] Filed: Jan. 17, 1990

[51] Int. Cl.[5] ..... F02M 23/00

[52] U.S. Cl. ..... 123/533; 123/531

[58] Field of Search ..... 123/531, 533, 585

[56] References Cited

U.S. PATENT DOCUMENTS

| | | | |
|---|---|---|---|
| 3,990,421 | 11/1976 | Grainger | 123/556 |
| 4,206,599 | 6/1980 | Sumiyoshi et al. | 123/531 |
| 4,387,695 | 6/1983 | Hoppel et al. | 123/531 |
| 4,429,674 | 2/1984 | Lubbing | 123/533 |
| 4,543,939 | 10/1985 | Ehrhart et al. | 123/531 |
| 4,636,148 | 1/1987 | Takao et al. | 417/286 |
| 4,690,118 | 9/1987 | Hofbauer et al. | 123/533 |
| 4,754,740 | 7/1988 | Emmenthal et al. | 123/533 |
| 4,756,293 | 7/1988 | Suzuki et al. | 123/533 |
| 4,794,902 | 1/1989 | McKay | 123/533 |
| 4,800,862 | 1/1989 | McKay et al. | 123/531 |
| 4,804,317 | 2/1989 | Smart et al. | 418/179 |
| 4,841,942 | 6/1989 | McKay | 123/533 |
| 4,962,745 | 10/1990 | Ohno et al. | 123/533 |

FOREIGN PATENT DOCUMENTS

| | | | |
|---|---|---|---|
| 3203558 | 9/1982 | Fed. Rep. of Germany | 123/585 |
| 3304095 | 8/1984 | Fed. Rep. of Germany | 123/533 |

*Primary Examiner*—Tony M. Argenbright
*Assistant Examiner*—Robert E. Mates
*Attorney, Agent, or Firm*—John C. Evans

[57] ABSTRACT

An air fuel injection system for an internal combustion engine includes a plurality of fuel injectors supplied with fuel from a common fuel supply and supplied with air for producing a fuel spray pattern immediately upstream of an inlet valve to the combustion bowl of one of the engines cylinders and downstream of the induction air passage which supplies combustion air to the combustion bowl. The injection air supply is provided by an integral motor pump assembly having an electric motor driving a balanced lobe vane pump. The pump motor is electrically driven to charge the fuel injectors with high pressure air before the engine is started and independent of engine operation. The balanced lobe vane pump has an inlet connected to the PVC valve of the engine to provide a oil mist lubrication of the operative wear surfaces of the vane pump and the vane pump has an inlet connected to an air manifold for supplying lower noise and pulse air pressure thereto.

10 Claims, 3 Drawing Sheets

PORT FUEL INJECTION AND INDUCTION SYSTEM FOR INTERNAL COMBUSTION ENGINE

BACKGROUND OF THE INVENTION

1. Field of the Invention

This invention relates to port fuel injection and induction systems for internal combustion engines and more particularly to such systems wherein air is supplied to a port fuel injector from an air manifold for injecting fuel into the air induction stream from an intake duct supplied from an intake manifold through a throttle body.

2. Prior Art

U.S. Pat. No. 3,990,421 discloses an anti-pollution system for an internal combustion engine. The engine has a PVC valve connected to a venting air injector. However, the air injector pump is a scroll pump which is connected to be driven by a fan pulley driven belt. The system does not provide an integral electric motor for driving a pump to supply air to a port fuel injector independently of engine start-up or engine operation. Also, the system of the '421 patent does not provide for mist lubrication of the rotary components of a pump solely in response to air inlet flow to the pump.

U.S. Pat. No. 4,206,599 discloses an internal combustion engine having a fuel injector system and a secondary air supply system. The secondary air system includes an air pump and air injection manifold for supplying air to the exhaust ports of an engine. There is no suggestion of providing an electric motor driven pump for supplying fuel injection air independently of engine start-up or engine operation. Also there is no suggestion of providing lubrication to such a pump solely in response to air inlet flow to the pump.

U.S. Pat. No. 4,543,939 discloses an air-fuel supply system wherein a rotary vane pump has both an air inlet and a fuel inlet to supply air/fuel to the pump for mixing therein. The air/fuel mixture produced by the pump is discharged directly into the intake manifold of an internal combustion engine. The system does not include an integral electric motor for driving an air pump to supply injection air to a port fuel injection and induction system independently of engine start-up or engine operation. Furthermore, there is no provision for providing a mist lubrication of the pump solely in response to flow of inlet air to the pump.

U.S. Pat. Nos. 4,636,148 and 4,804,317 show vane type pumps that have been used in other applications. These patents do not disclose or suggest the use of a electric motor driven balanced vane pump to supply air to the fuel injector of a port fuel injection and induction system independently of engine start-up or engine operation. Furthermore, there is no provision for providing a mist lubrication of the pump solely in response to flow of inlet air to the rotary vane pump.

SUMMARY OF THE INVENTION

An object of the present invention is to improve the operation of a port fuel injection and induction system by the provision of a integral electric motor driven air pump for supplying air to a fuel injector.

Another object of the present invention is to provide a pump for supplying injection air to injectors of a port fuel and inductions system wherein the pump is lubricated by engine oil solely in response to the operation of the air pump.

Still another object of the present invention is to provide a pump of the type set-forth in the preceding object wherein the air pump has its inlet connected to an engine PVC valve to provide a lubrication mist for the air pump during operation thereof.

A feature of the present invention is to provide for self lubrication of an air pump in a port fuel injection and induction system by connecting an outlet port of a PVC vale to a filter which in turn is connected to the inlet of an air pump having its outlet connected to an air manifold and wherein the air manifold has a multiplicity of air lines each connected to a fuel injector for directing a fuel spray pattern upstream of an inlet valve having primary combustion air supplied thereto through an intake duct from a throttle body assembly.

Yet another feature of the present invention is to provide for a method for controlling fuel injection by such a pump and electric motor drive under the control of an engine computer to vary the speed of the air pump for adjusting the fuel flow in accordance with engine operating conditions.

Various other objects, features and attendant advantages of the present invention will be more fully appreciated as the same become better understood from the following detailed description when considered in connection with the accompanying drawings in which:

DETAILED DESCRIPTION OF THE PREFERRED EMBODIMENT

Figure 1:
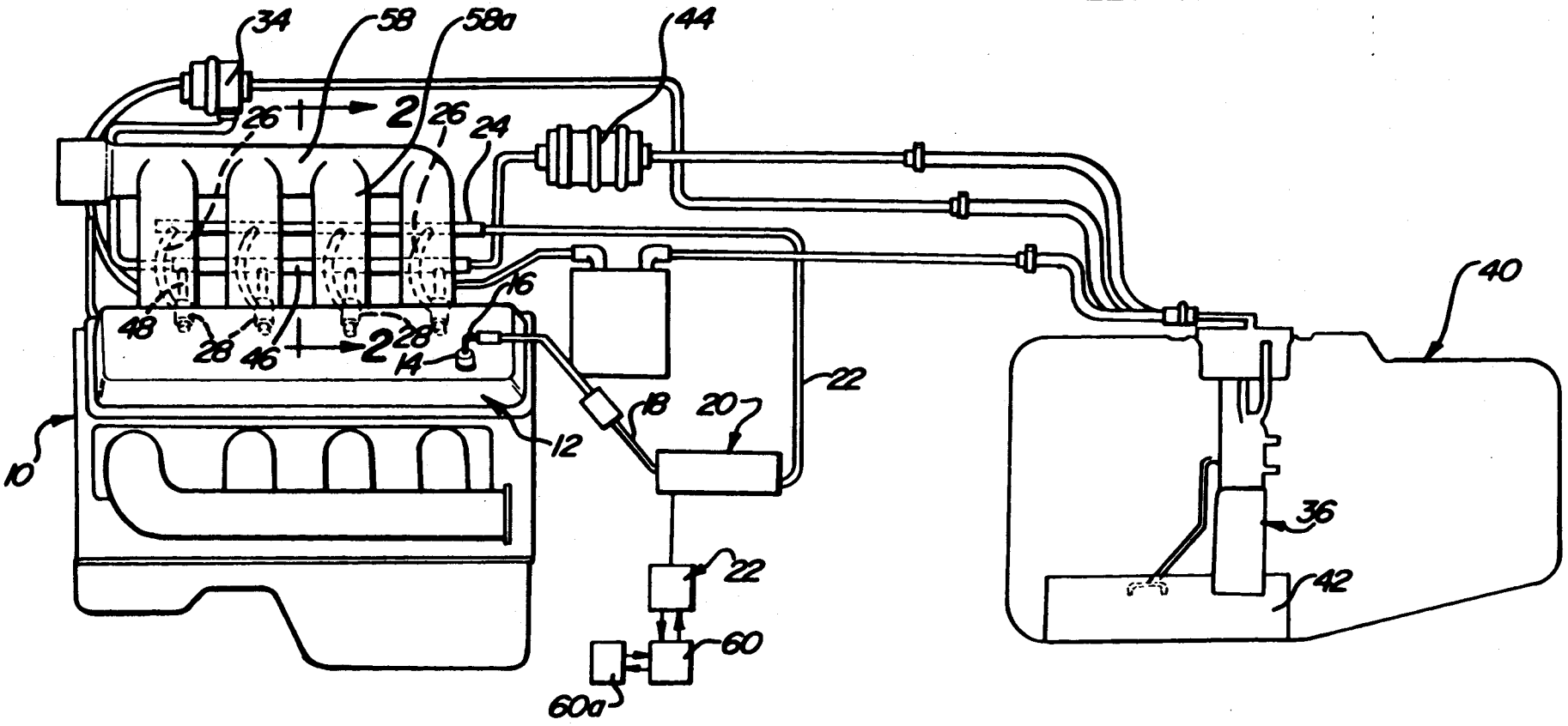
FIG. 1. is a diagrammatic view of a internal combustion air injection system including the present invention.

Referring now to FIG. 1, an internal combustion engine 10 is illustrated having a valve chamber housing 12 with a PVC valve 14 connected thereto. The outlet 16 of the PVC valve 14 is connected by a conduit 18 to the inlet of an integral electric motor and pump assembly 20. A controller 22 supplies electrical power to the assembly 20.

Figure 2:
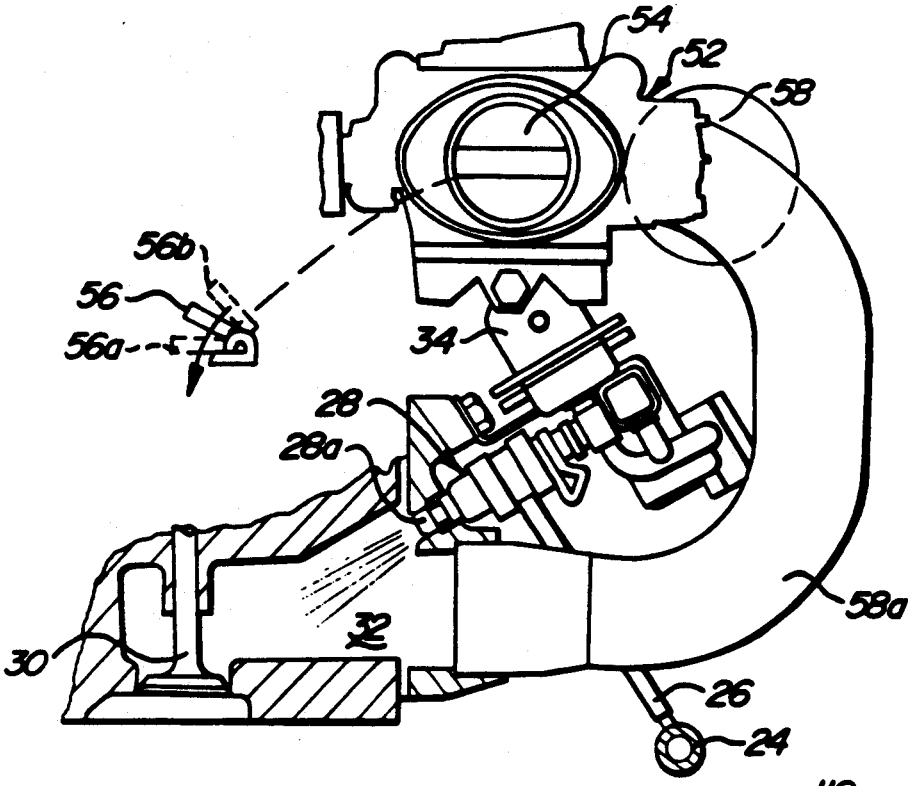
FIG. 2 is a sectional view taken along the line 2—2 of FIG. 1 looking in the direction of the arrows.

The outlet of the motor and pump assembly 20 is connected by a conduit 22 to an air manifold 24 having a plurality of branch lines 26 therefrom for supplying injection air to each of a plurality of fuel injectors 28. The fuel injectors 28 are each aligned with an inlet valve 30 of the engine at an inlet port 32 thereto as best shown in FIG. 2. Each of the fuel injectors 28 has fuel supplied thereto through a pressure regulator 34. The pressure regulator 34 controls the fuel supply pressure at a desired level such that the amount of fuel flow through each of the inlet valves 30 will be established by the quantity of air injected into each of the injectors 28. The fuel pump 36 draws fuel from the sump 38 of a fuel tank 40 for distribution through a supply line 42, a fuel filter 44, thence to a fuel manifold 46 thence through branch fuel lines 48 to each injector 28.

The volume of air injection through each of the branch lines 26 will determine the quantity of fuel flow from the injector 28. The level of fuel flow may be adjusted for different operating conditions by varying the speed of an electric motor 50 to be described. The fuel spray pattern is directed into the primary air supply which is directed through a throttle body assembly 52 having a throttle plate 54 therein which is positioned by a foot pedal 56, e.g., at engine idle the throttle plate 54 is partially closed to reduce the air flow through an intake manifold 58 having branch intake ducts **58*a* which discharge into the inlet port 32 of each of the intake valves 30 at a point immediately upstream of the outlet end 28*a* of each of the fuel injectors 28. Greater amounts of air flow pass through the intake duct 58*a* as the foot pedal is depressed. At the same time more fuel is directed through the injector 28 by increasing the volume of air directed thereto by increasing the speed of the motor 50 which drives the integral motor and pump assembly 20**.

One feature of the present invention is that the integral motor and pump assembly can be controlled by a microprocessor engine controller 60. The method of the present invention includes regulating the speed of the electric motor 50 for driving an air injection pump to control the rate of air flow therefrom. The method includes the steps of sensing an engine command signal, e.g., movement of the foot pedal 56 from a first position **56*a* to a second position 56*b* and sensing the respective positions. A pulse signal is produced which reflects the physical distance traveled between position 56*a* and 56*b*. In turn the distance traveled is a reflection of the amount of opening movement of the throttle plate 54 and is a measure of the mass air flow into the engine. The mass air flow rate is compared to a signal from a function generator 60*a* which produces a signal emulating a desired fuel flow for different sensed air flow rates to the engines. The command signal for increased air flow is compared to that of the function generator 60*a* and the speed of the motor 50 is either increased or decreased to change the amount of injection air into the fuel injector 28 in a corresponding manner so as to produce a fuel flow that will meet the needs of the engine command signal. The microprocessor 60 can also be programmed to modify the speed of electric motor 50 so as to control the air/fuel ratio to meet desired emission control standards. Another aspect of the present invention is that the microprocessor 60 can be programmed to condition the controller 22 to energize the electric motor 50** before the engine starts and independent of engine operations so as to precharge the fuel injectors with pressure air to improve fuel injection at engine start.

Another feature of the present invention is that the integral electric motor and pump assembly 20 has a common housing 62 for enclosing both the electric motor 50 and a high speed, balanced pump 70 such that both the electric motor 50 and the pump 70 can be mounted as a unit within the engine compartment of a vehicle for ease of original manufacture and replacement. The provision of an integral motor 50 eliminates the need for a fan pulley drive to the air pump and also enables the motor 50 be driven at speeds independent of the output speed of the engine 10.

Figure 3:
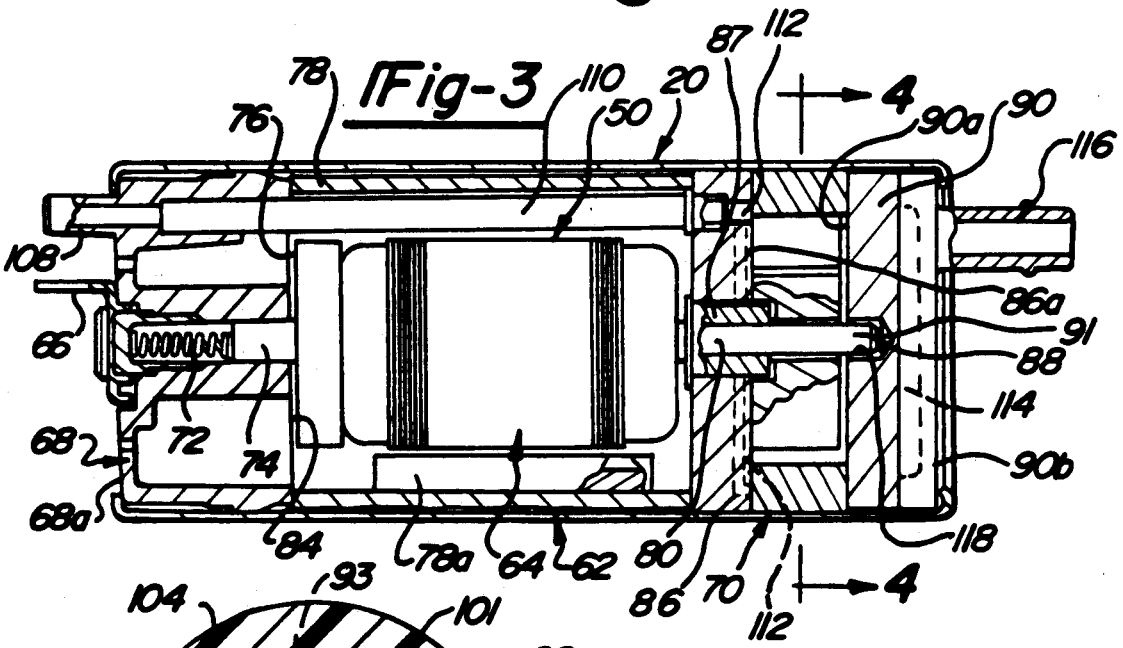
FIG. 3 is a longitudinal sectional view of a integral motor pump assembly used in the air injection system of FIG. 1.

As shown in FIG. 3, the electric motor 50 is illustrated as a D.C. brush type motor with a wound rotor 64 having current supplied thereto from a terminal 66 on end closure 68 on the motor housing 62. The terminal 66 is suitably insulated from the motor housing 62 and is electrically connected via a spring conductor 72 to a brush 74 that is biased by the spring conductor 72 against a radial commutator surface 76 with circumferentially spaced and electrically insulated segments of a known kind. The region of contact between the commutator surface 76 and the end **74*a* of the brush 74 is offset from the longitudinal axis of the rotor 64. A stator 78 is supported by the housing 62 in radially outwardly spaced, surrounding relationship to the rotor 64. The stator 78 includes armature pieces 78*a* at spaced circumferential points for completing the magnetic circuits of the advancing flux fields which drive the motor in accordance with the magnitude of the applied D.C. exciting current through the terminal 66. The rotor 64 has end shafts 80 one of which is shown in FIG. 3 at the left end of the rotor 64. Each of the end shafts 80 is supported by a bearing bushing 82 supported respectively in a wall portion 84 of the end closure 68 and in a wall plate 86 that forms one end of the motor 50 and the inboard wall of the pump 70. The outboard shaft 80 has an extension 88 that is cantilevered from the wall plate 86 to be supported by a pump cover plate 90 at a recess 91** therein.

The electric motor 50 can also be a brushless motor including selectively energizable windings and a permanent magnet motor interactive to produce variable speed pump drive which eliminates a maintenance requirement of brush replacement thus making the integral motor and pump assembly better suited to meet stringent motor vehicle warranty standards.

Figure 4:
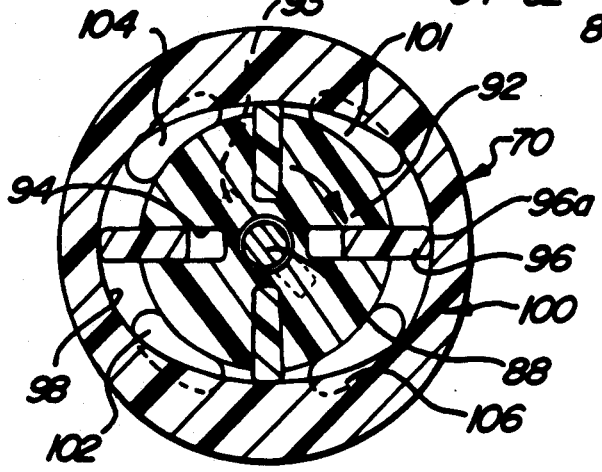
FIG. 4 is a cross-sectional view taken along the line 2—2 of FIG. 3 looking in the direction of the arrows.

The pump 70 is a pressure balanced "two-lobe" pump which has a rotor 92 connected by a cross-pin 93 to the shaft extension 88. The rotor 90 has a circular cross-section as shown in FIG. 4. A plurality of diametrically located, circumferentially spaced vane slots 94 each receive a reciprocating vane 96 having a rounded tip **96*a* at the free end thereof. The rounded tips 96*a* are held by centrifugal action during rotation of the rotor 92 against the surface 98 of a 3-4-5 polynomial eccentric ring 100. The surface 98 has a small dimension along the Y axis which forces each of the vanes 96 fully into their respective vane slot 96 and the surface 98 has a maximum dimension along the X axis which extends the vanes 96 approximately half way out of the slots 96. The 3-4-5 polynomial eccentric ring 98 is clearly shown in FIG. 4 as having a 3-4-5 ratio of radii forming the surface 98 of the eccentric ring 100. The small dimension along the Y axis represents the smallest ratio unit "3"; the large dimension along the X axis represents the largest ratio unit "5"; and the surface segment therebetween represents the intermediate ratio unit "4". The sweep of the vanes produced between the illustrated extremes of movement thereof will draw inlet air through diametrically opposed inlet ports 101, 102 for discharge through diametrically opposed outlet ports 104, 106. The inlet ports 101, 102 are formed in the wall plate 86 in the outboard surface 86*a* thereof. The outlet ports 104, 106 are formed in the pump cover plate 90 at the inboard surface 90*a* thereof. The inlet ports 101, 102 are connected to an inlet 108 formed in the end closure 68. Inlet 108 is connected by a cross-over tube 110 that extends the length of the motor 50 for connection to an inlet passage 112 in the wall plate 86 leading to each port 101, 102. The pump cover plate 90 includes a manifold groove 114 that directs flow from the outlet ports 104, 106 to an outlet fitting 116. The rotor 92, eccentric ring 100 and vanes 96** are made of high temperature resistance carbon-graphite material suitable for high under hood temperature operation. The use of diametrically located inlet and outlet ports and four vanes disposed as illustrated produces a "two-lobe" pump section that balances the pressure forces on the rotor shafts 80 so as to resolve the loads on bearing 82 and a bearing 118 for the shaft extension 88 to a zero load condition.

The outer housing 62 has its opposite ends 120, 122 deformed into hermetically sealed engagement with the outer surface 68*a* of the end closure 68 and the outer surface 90*b* of the pump cover plate so as to define a sealed construction for under hood applications.

In addition to being pressure balanced and hermetically sealed, the integral motor pump assembly 20 is lubricated for long life.

Another feature of the present invention is the provision of continuous lubrication of the internal wear surfaces of the pump 70 solely in response to inlet air flow through the inlet 108 as provided by connection of the PVC valve outlet 16 to the inlet 108. The connection provides a lubrication mist which will prolong the life of the pump 70. A filter 124 can be provided in the conduit 18 for assuring a clean air flow to pump 70 having a limited amount of lubrication mist. The arrangement prevents excessive withdrawal of oil from the valve chamber while assuring an adequate flow of lubricant to the wear surfaces of the pump 70.

Figure 5:
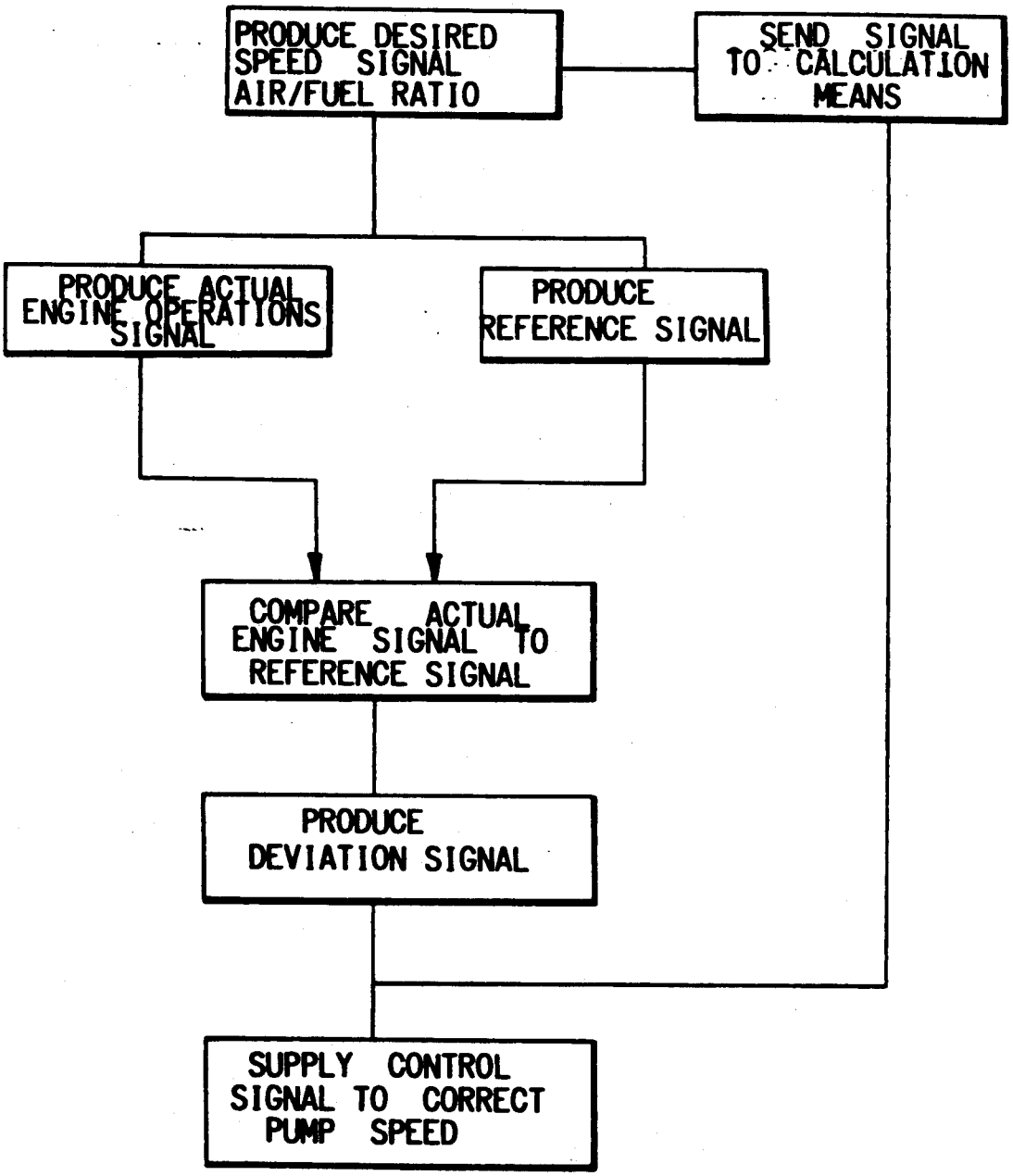
FIG. 5 is a flow chart of a control method of the present invention.

The method of the present invention is shown in the flow chart of FIG. 5. It is based on the ability to control pump speed by varying the energization of a brushless motor through use of an engine computer. It includes the steps of establishing a desired air/fuel ratio for different engine operating conditions and programming the computer to provide a function generator for producing a reference signal for each engine operating condition. Sensing an engine condition and producing a signal indicative of the engine condition. Comparing the engine condition signal to a signal produced by a function generator which is indicative of a desired air/fuel ratio. If there is a positive error signal an output is directed from the controller 22 to increase the drive speed of the pump to increase the amount of injection air directed to the injectors 28 so as to increase the amount of fuel to reduce the error signal to zero. Conversely, if there is a negative error signal an output is directed from the controller to decrease the drive speed of the pump 70 so as to reduce the fuel supply to reduce the error signal to zero.

Although the invention has been described in accordance with a single embodiment of the apparatus and a single embodiment of the method, it will become apparent to those skilled in the art that numerous modifications and variations can be made within the scope and spirit of the invention as defined in the attached claims.

What is claimed is:

1. An engine having a valve cover with a PCV valve to vent a valve chamber so as to eliminate oil and gas fumes therefrom and an automotive fuel injection system having a port fuel injector connected to a fuel supply and to an air manifold for injecting an air/fuel mixture into the injector for producing a fuel spray pattern at the outlet of an air induction passage from a throttle body assembly and upstream of an inlet valve to the combustion chamber of an internal combustion engine characterized by an integral electric motor driven pump assembly means supplying the injection air to the air manifold; said motor pump assembly means having a pump inlet connected to said PVC valve for providing a lubrication mist to said pump during the operation thereof and said motor pump assembly means having a pump outlet connected to the inlet of said air manifold.

2. The internal combustion engine of claim 1, further characterized by said integral electric motor driven pump assembly being a vane pump with rotor means; bearing means supporting said rotor means and said rotor means including means for producing a balanced loading on said bearing means for producing substantially zero force bearing loads during rotation of said rotor means.

3. The internal combustion engine of claim 1, further characterized by said integral electric motor driven pump assembly located within the engine compartment.

4. The internal combustion engine of claim 1, further characterized by said integral motor pump assembly including brushless motor means and said brushless motor means including selectively energizable windings and a permanent magnet rotor interactive to produce variable speed pump drive; and engine computer means for producing signals to said energizable windings in accordance with engine operating conditions to vary the speed of said integral electric motor driven pump assembly to produce changes in the volume of injection air so as to vary the air/fuel ratio in accordance with engine operating conditions.

5. The internal combustion engine of claim 1, further characterized by said integral motor pump assembly including a vane pump having means forming opposed inlets and outlets and an eccentric ring formed as a polynomial 3-4-5 surface and including a circular rotor having vanes thereon located equidistantly on said circular rotor and including tips engageable with said eccentric ring to draw intake air through said opposed inlets for discharge through said opposed outlets during rotation of said circular rotor with respect to said eccentric ring.

6. An engine having a fuel injection system having a port fuel injector connected to a fuel supply and to an air manifold for injecting an air/fuel mixture into the injector for producing a fuel spray pattern at the outlet of an air induction passage from a throttle body assembly and upstream of a inlet valve to the combustion chamber of an internal combustion engine characterized by an integral electric motor driven pump assembly means supplying the injection air to the air manifold; control means for energizing said integral electric motor pump assembly means and for precharging said port fuel injector with high pressure air before the engine starts.

7. The internal combustion engine of claim 6, further characterized by said integral electric motor driven pump assembly being a vane pump with rotor means; bearing means supporting said rotor means and said rotor means including means for producing a balanced loading on said bearing means for producing substantially zero force bearing loads during rotation of said rotor means.

8. The internal combustion engine of claim 6, further characterized by said integral electric motor driven pump assembly located within the engine compartment.

9. The internal combustion engine of claim 6, further characterized by said integral motor pump assembly including brushless motor means and said brushless motor means including selectively energizable windings and a permanent magnet rotor interactive to produce variable speed pump drive; and engine computer means for producing signals to said energizable windings in accordance with engine operating conditions to vary the speed of said integral electric motor driven pump assembly to produce changes in the volume of injection air so as to vary the air/fuel ratio in accordance with engine operating conditions.

10. The internal combustion engine of claim 6, further characterized by said integral motor pump assembly including a vane pump having means forming opposed inlets and outlets and an eccentric ring formed as a polynomial 3-4-5 surface and including a circular rotor having vanes thereon located equidistantly on said circular rotor and including tips engageable with said eccentric ring to draw intake air through said opposed inlets for discharge through said opposed outlets during rotation of said circular rotor with respect to said eccentric ring.

* * * * *